US005758804A

United States Patent [19]

Wirth

[11] Patent Number: 5,758,804

[45] Date of Patent: Jun. 2, 1998

[54] CLIP-ON POURING SPOUT

[76] Inventor: Steven E. Wirth, 8131 Pennsylvania Cir, Bloomington, Minn. 55439

[21] Appl. No.: 685,905

[22] Filed: Jul. 22, 1996

[51] Int. Cl.[6] ..... B65D 25/50

[52] U.S. Cl. ..... 222/460; 222/567

[58] Field of Search ..... 222/460, 461, 222/462, 567, 570; D9/434, 435, 447; D7/700

[56] References Cited

U.S. PATENT DOCUMENTS

| | | | |
|---|---|---|---|
| 2,580,811 | 1/1952 | Martinsen | 222/567 X |
| 2,684,793 | 7/1954 | Warrick | 222/567 |
| 3,430,804 | 3/1969 | Bernas | 222/567 X |
| 3,708,092 | 1/1973 | Frazer | 222/567 |
| 3,987,943 | 10/1976 | Richmond, Jr. | 222/570 |
| 4,111,340 | 9/1978 | Greenhow et al. | 222/567 X |
| 4,231,497 | 11/1980 | Bourbon | 222/567 X |
| 4,811,870 | 3/1989 | Bianco | 222/461 |

FOREIGN PATENT DOCUMENTS

| | | | |
|---|---|---|---|
| 2441553 | 6/1980 | France | 222/567 |
| 168821 | 9/1921 | United Kingdom | 222/567 |
| 1305321 | 1/1973 | United Kingdom | 222/567 |

*Primary Examiner*—Kenneth Bomberg
*Attorney, Agent, or Firm*—Roger W. Jensen

[57] ABSTRACT

An improved clip-on pouring spout is removably attachable to a screw neck of a container. The pouring spout has a funnel section with a mated prong pair extending proximally from a larger cross-sectional opening of the funnel. The prong pair together defines essentially an external perimeter of the neck. A lumen surface of the prong pair can have an interiorly extending rib, which provides an essentially tight connection when the prong pair is attached to the neck. The rib can extend from the lumen surface closer to an exterior surface of the funnel section, or closer to an interior surface of the funnel section, or intermediate between the exterior and the interior surfaces of the funnel section. The clip-on pouring spout can have more than one prong pair, e.g., four prong pairs, with each prong pair sized to accommodate the same or differently sized screw necks. The pouring spout with a plurality of prong pairs can have an interiorly extending rib on each prong pair.

17 Claims, 2 Drawing Sheets

CLIP-ON POURING SPOUT

FIELD OF THE INVENTION

This invention relates to the field of generally funnel-shaped spouts for use in facilitating pouring contents from a container with a screw-type neck. More particularly, this invention is an improvement of a clip-on pouring spout for removable attachment to a neck of a container.

BACKGROUND OF THE INVENTION

Bottles and other similar receptacles provided with screw-type neck openings are very common containers for fluids and other pourable commodities. Often, dispensing the contents of the container may prove to be rather cumbersome, either because of the large and heavy size of the container or because the contents are to be delivered to a site which may be difficult to accurately and conveniently access without wasteful spillage. Consumers are readily familiar with the difficulty of pouring beverages from gallon-sized or larger containers into a smaller container, such as a small glass or a small diameter necked bottle. Attempting to pour automotive fluids, such as lubricating oil or windshield washer fluid, from large screw-necked containers directly to the appropriate location in the automobile engine can result in spilling and waste of the contents, as well as adding to accumulation of dirt and debris on the engine. If the contents to be delivered are toxic or hazardous in any way, inaccurate pouring can be dangerous to the persons involved. The use of a separate funnel is cumbersome and often a less than desirable solution.

Previously, there has been available a clip-on pouring spout, available from the assignee of the present application, Niches, LLC of Minnesota, that answers some of these problems. The previously available clip-on pouring spout is removably attachable to a screwtype neck of a container. It has a funnel section which has a proximal larger cross-sectional opening tapering to a distal smaller cross-sectional opening. A mated prong pair extends proximally from the larger cross-sectional opening of the funnel. The prong pair together defines essentially an external perimeter of the neck. The prong pair is designed and adapted for removable attachment to the neck. While this previous clip-on pouring spout is quite useful for its purpose, it has certain disadvantages. One disadvantage is that, since the pouring spout is provided with one a single prong pair, it can be used with only a single sized neck opening. Another disadvantage is that the prong pair does not provide a sufficiently fluid-tight connection to the neck opening and thus the contents of the container leak during pouring. There is thus a need for an improved clip-on pouring spout that will eliminate these problems.

SUMMARY OF THE INVENTION

The present invention is an improved clip-on pouring spout removably attachable to a screw-type neck of a container. The pouring spout has a funnel section having a proximal larger cross-sectional opening tapering to a distal smaller cross-sectional opening. A mated prong pair extends proximally from the larger cross-sectional opening of the funnel. The prong pair together defines essentially an external perimeter of the neck. A lumen surface of the prong pair can be provided with an interiorly extending rib or ridge. When the prong pair is attached to the neck, the prong pair, together with the extending rib or ridge, provides a liquid-tight connection to the neck.

The interiorly extending ridge can have various embodiments. The ridge can extend from the lumen surface closer to an exterior surface of the funnel section or closer to an interior surface of the funnel section. Alternatively, the ridge can extend from the lumen surface intermediate between the exterior and the interior surfaces of the funnel section. The clip-on pouring spout can have more than one prong pair, for example, four prong pairs. Each prong pair can be sized to accommodate a differently sized neck. In another embodiment, the clip-on pouring spout can be provided with more than one prong pair, with each prong pair sized to attach a differently sized screw-type neck and with each prong pair having the interiorly extending ridge.

DETAILED DESCRIPTION OF THE INVENTION

Figure 1:
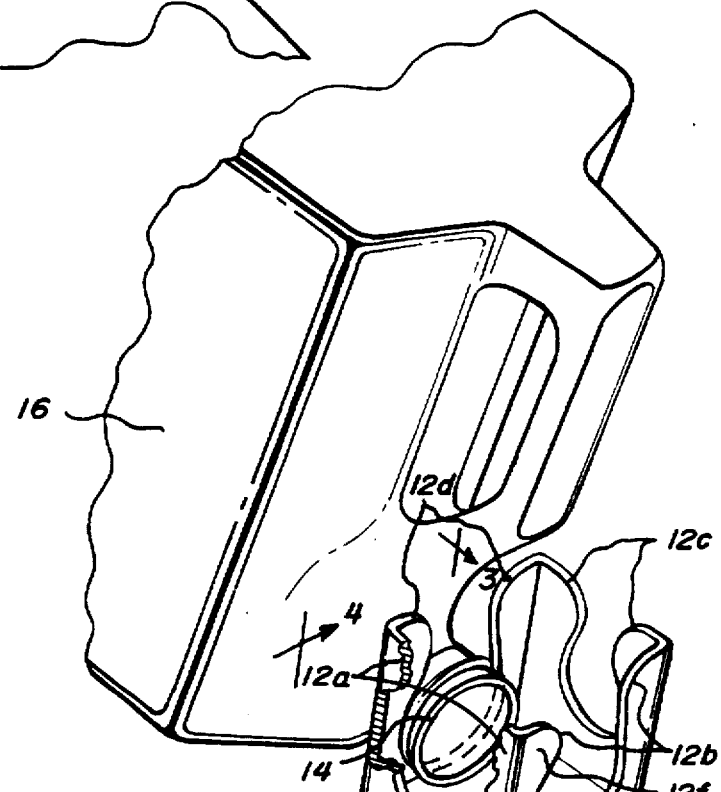
FIG. 1 illustrates a perspective view of a clip-on pouring spout of this invention having four prong pairs, shown attached to a screw-type necked container.
Figure 2:
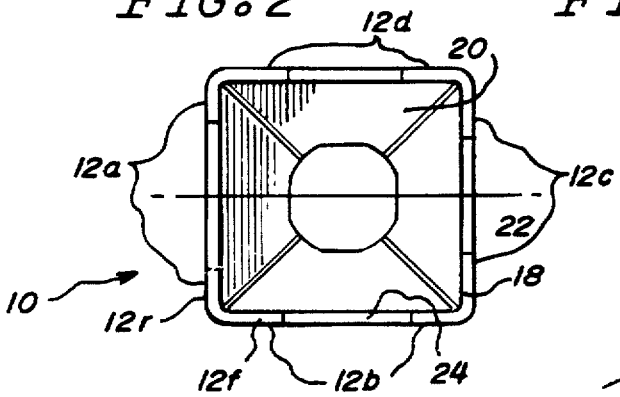
FIG. 2 is a cross-sectional view of the clip-on pouring spout, taken along the line 2—2 of FIG. 4, as viewed from the larger opening of the funnel section.
Figure 3:
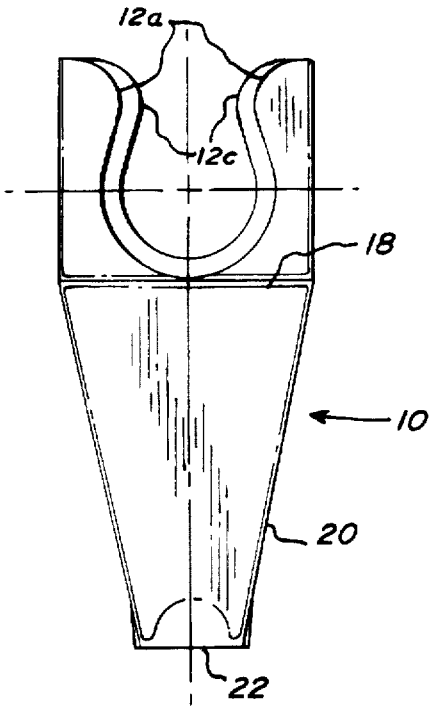
FIG. 3 is a side view of the clip-on pouring spout, taken along the line 3—3 in FIG. 1, showing the largest and second largest prong pairs.
Figure 4:
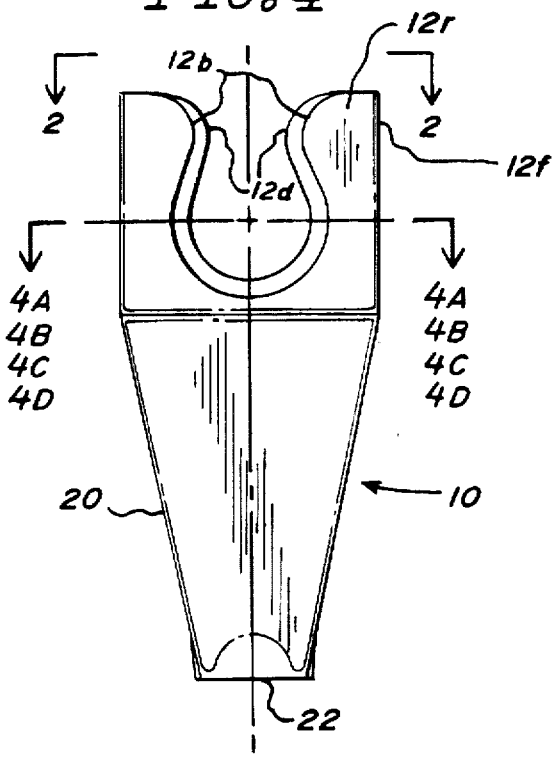
FIG. 4 is a side view of the clip-on pouring spout, taken along the line 4—4 of FIG. 1, showing the smallest and second smallest prong pairs.
Figure 4A:
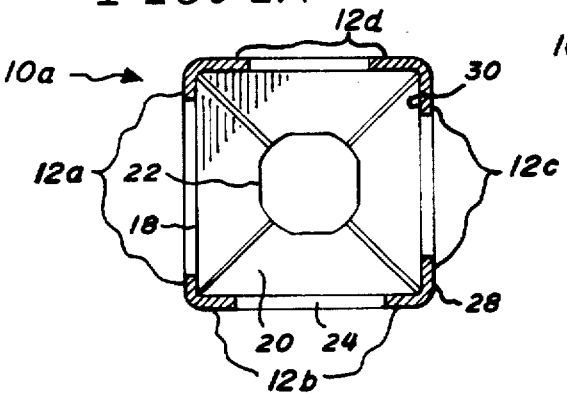
FIG. 4A is a cross-sectional view of a first alternative embodiment of the clip-on pouring spout taken along the line 4A—4A of FIG. 4.

A first embodiment of the clip-on pouring spout 10 according to the present invention is illustrated with reference to FIGS. 1 through 4 and 4A. The clip-on pouring spout 10 is shown with a prong pair 12 in attachment to a neck 14 of a container 16. Note that the prong pair 12 defines essentially a perimeter of the neck 14, so that a close fit is achieved between the prong pair 12 and the neck 14. With the clip-on pouring spout 10 in its attached position, it can easily be seen that a longitudinal axis of the clip-on pouring spout 10 is essentially at a right angle to a longitudinal axis of the neck 14. Thus, when the container 16 is tipped to dispense its contents, the contents will readily enter the larger cross-sectional opening 18 of the funnel section 20 of the pouring spout 10 to exit the smaller cross-sectional opening 22 of the funnel section 20. As seen in FIGS. 1, 2 and 4A, four prong pairs 12*a*, 12*b*, 12*c* and 12*d* are formed around the perimeter of the larger opening 18 of the funnel section 20. As shown in FIGS. 1 and 4, the prong pairs 12 are formed such that a right prong 12*r* of a first prong pair, e.g., 12*a*, is constructed as a single member with a left prong 12*f* of a counterclockwise adjacent prong pair, e.g., 12*b*, respectively. All of the prong pairs 12 may define the perimeter of the same size neck 14 or each prong pair 12*a*, 12*b*, 12*c* and 12*d* may define the perimeter of different size necks 14, so that the clip-on pouring spout 10 can be used with containers 16 having necks 14 of different sizes. As can perhaps best be seen with reference to FIGS. 3 and 4, prong pair 12*a* is the largest, prong pair 12*c* is the second largest, prong pair 12*d* is the smallest and prong pair 12*b* is the second smallest. As shown in FIGS. 1, 2 and 4A, the lumen 24 of each prong pair 12 has a generally smooth surface.

Figure 5:
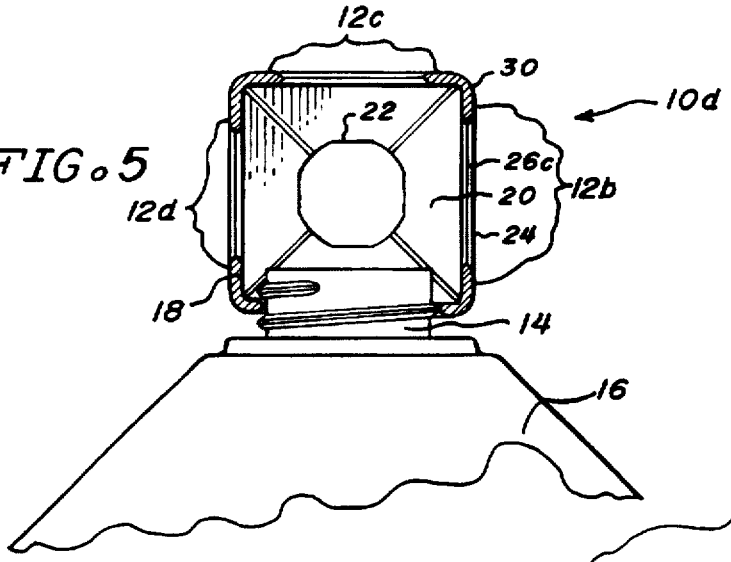
FIG. 5 is a view of a clip-on pouring spout according to FIG. 4C attached to a screw-type neck as viewed from the larger opening of the funnel section.
Figure 4B:
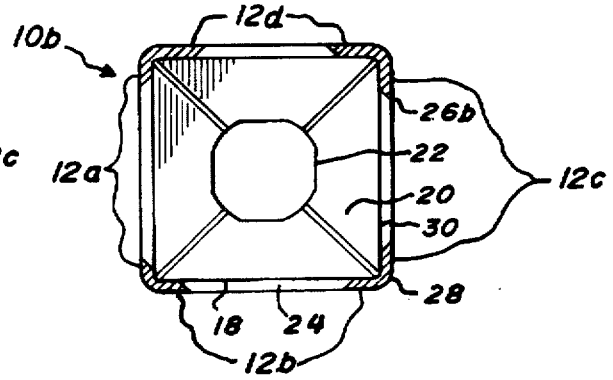
FIG. 4B is a cross-sectional view of a first alternative embodiment of the clip-on pouring spout taken along the line 4B—4B of FIG. 4, showing an interiorly extending ridge on each prong pair, with the ridge extending from the lumen surface of the prong pair closer to the exterior surface of the funnel section.
Figure 4C:
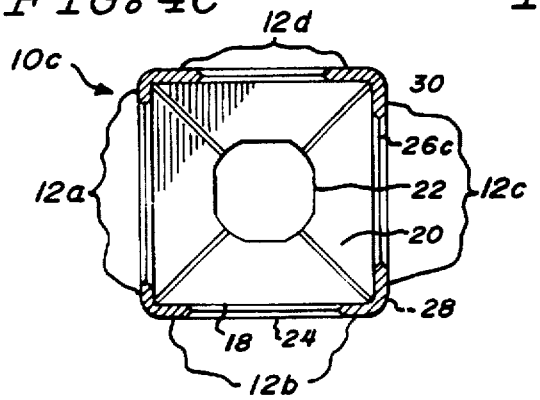
FIG. 4C is a cross-sectional view of a second alternative embodiment of the clip-on pouring spout taken along the line 4C—4C of FIG. 4, showing an interiorly extending ridge on each prong pair, with the ridge extending from the lumen surface intermediate between the interior and the exterior surface of the funnel section.
Figure 4D:
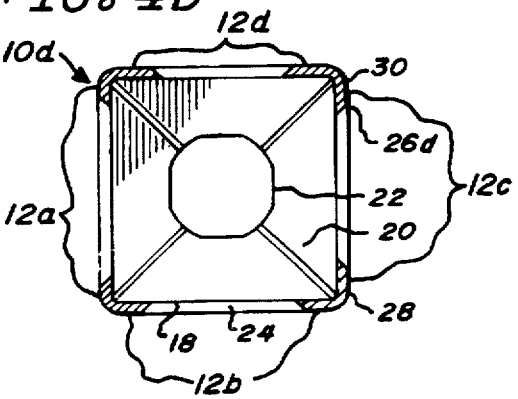
FIG. 4D is a cross-sectional view of a third alternative embodiment of the clip-on pouring spout taken along the line 4D—4D of FIG. 4, showing an interiorly extending ridge on each prong pair, with the ridge extending from the lumen surface of the prong pair closer to the interior surface of the funnel section.

Alternative embodiments of the clip-on pouring spout 10*b*, 10*c* and 10*d* are illustrated with reference to FIGS. 4, 4B, 4C, 4D and 5. As can perhaps best be seen in FIG. 4B, the lumen 24 of each prong pair 12 is formed with a perimeter rib 26 extending to the interior of each prong pair 12. The perimeter rib 26*b* can extend interiorly from the lumen 24 of each prong pair 12 closer to an exterior surface 28 of the funnel section 20, as illustrated in FIG. 4B. As can perhaps best be seen in FIG. 4C, the lumen 24 of each prong pair 12 can be formed with a perimeter rib 26*c* extending interiorly from the lumen 24 of each prong pair 12 intermediate 4 between the interior 28 and exterior 30 surfaces of the funnel section 20. As can also be seen in FIG. 4D, the lumen 24 of each prong pair 12 can be formed with a perimeter rib 26*d* extending interiorly from the lumen 24 of each prong pair 12 closer to an interior surface 30 of the funnel section 20. FIG. 5 illustrates the prong pair 12 with the perimeter rib 26*c* securely interfitting with the spiral screw neck 14. By forming the clip-on pouring spout 10 with a perimeter rib 26 according to the present invention, a more leak proof connection can be formed to the neck 14 of the container 16.

It will be understood that the clip-on pouring spout 10 of this invention may be constructed with any combination of the presently disclosed improvements. That is, the clip-on pouring spout 10 may be formed with any desired number of prong pairs 12. When the clip-on pouring spout 10 is formed with a plurality of prong pairs 12, the prong pairs 12 may be sized to fit the same or different sizes of container necks 14. The clip-on pouring spout 10 may be formed with a single prong pair 12 shaped with a perimeter rib 26, 26*b*, 26*c* or 26*d*. When the clip-on pouring spout 10 is formed with a plurality of prong pairs 12, the prong pairs 12 may be sized to fit the same or different sizes of container necks 14 and each prong pair may be provided with a perimeter rib 26, 26*b*, 26*c* or 26*d*. As can be seen with reference to any of FIGS. 1–4, 4A, 4B, 4C, 4D and 5, when the pouring spout 10 has four prong pairs 12, the funnel section 20 and correspondingly the four prong pairs 12 may have a generally square cross-section. This allows each prong pair 12 to be generally planar, ensuring a close fit to the neck 14, while the square cross-section of the funnel section 20 deters the pouring spout 10 from rolling out of the user' 5 reach when placed on an inclined surface.

The present clip-on pouring spout 10 can be made from suitable material, including metal or any suitable resilient or flexible polymeric material. When made of a polymeric material, the pouring spout 10 can be formed by any type of plastics forming process, such as injection molding. Generally, the polymeric material will be resistant to the types of fluids or pourable contents with which it is to be used and will also be resistant to environmental extremes of temperature normally to be encountered in use. The pouring spout 10 can be formed to any desirable dimensions as determined by its intended use.

What is claimed is:

1. A clip-on pouring spout removably attachable to a neck of a container, the pouring spout comprising:

a funnel section having a proximal larger cross-sectional opening tapering to a distal smaller cross-sectional opening;

more than one mated prong pair extending proximally from the larger cross-sectional opening, each prong pair together defining a perimeter, a lumen surface of each prong pair provided with an interiorly extending ridge; and each prong pair designed and adapted for removable clip attachment to the neck, such that, when one of the prong pairs is clip attached to the neck, the attached prong pair, together with the extending ridge, provides an essentially tight connection to the neck.

2. A clip-on pouring spout according to claim 1, wherein each prong pair defines a differently sized perimeter.

3. A clip-on pouring spout according to claim 1, having four prong pairs.

4. A clip-on pouring spout according to claim 3, wherein each prong pair defines a differently sized perimeter.

5. A clip-on pouring spout removably attached to a neck of a container, the pouring spout comprising:

a funnel section having a proximal larger cross-sectional opening tapering to a distal smaller cross-sectional opening;

more than one mated prong pair extending proximally from the larger cross-sectional opening, each prong pair together defining a perimeter, a lumen surface of each prong pair provided with an interiorly extending ridge; and each prong pair designed and adapted for removable clip attachment to a neck, such that when each prong pair is clip attached to a neck, the prong pair, together with the extending ridge, provides an essentially tight connection to the neck.

6. A clip-on pouring spout according to claim 5 wherein each prong pair defines a differently sized perimeter.

7. A clip-on pouring spout according to claim 5, having four prong pairs.

8. A clip-on pouring spout according to claim 7, wherein each prong pair defines a differently sized perimeter.

9. A clip-on pouring spout removably attachable to a neck of a container, the pouring spout comprising:

a funnel section having a proximal larger cross-sectional opening tapering to a distal smaller diameter opening more than one mated prong pair extending proximally from the larger cross-sectional opening, each prong pair together defining therebetween a perimeter; and each prong pair designed and adapted for removable attachment to the neck.

10. A clip-on pouring spout according to claim 9, wherein each prong pair defines a differently sized perimeter.

11. A clip-on pouring spout according to claim 9, having four prong pairs.

12. A clip-on pouring spout according to claim 11, wherein each prong pair defines a differently sized perimeter.

13. A clip-on pouring spout according to claim 9, wherein a lumen surface of a prong pair is provided with an interiorly extending rib, such that, when the prong pair with the extending rib is attached to the neck, the prong pair, together with the extending rib, provides an essentially tight connection to the neck.

14. A clip-on pouring spout according to claim 13, wherein the rib extends from the lumen surface closer to an interior surface of the funnel section.

15. A clip-on pouring spout according to claim 13, wherein the rib extends from the lumen surface closer to an exterior surface of the funnel section.

16. A clip-on pouring spout according to claim 13, wherein the rib extends from the lumen surface intermediate between an exterior and an interior surface of the funnel section.

17. A clip-on pouring spout according to claim 12, wherein a lumen surface of each prong pair is provided with an interiorly extending rib, such that, when a prong pair is attached to a correspondingly sized neck, the prong pair, together with the extending rib, provides a liquidtight connection to the neck.

* * * * *